US011898760B2

(12) United States Patent
Su

(10) Patent No.: US 11,898,760 B2
(45) Date of Patent: Feb. 13, 2024

(54) OVEN FOR REDUCING USER SCALDING

(71) Applicants: GUANGDONG MIDEA KITCHEN APPLIANCES MANUFACTURING CO., LTD., Foshan (CN); MIDEA GROUP CO., LTD., Foshan (CN)

(72) Inventor: Zhenhe Su, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 241 days.

(21) Appl. No.: 17/352,342

(22) Filed: Jun. 20, 2021

(65) Prior Publication Data

US 2022/0205641 A1 Jun. 30, 2022

(30) Foreign Application Priority Data

Dec. 31, 2020 (CN) ..... 202011632995.5

(51) Int. Cl.
*F24C 15/02* (2006.01)

(52) U.S. Cl.
CPC ..... *F24C 15/028* (2013.01); *F24C 15/023* (2013.01)

(58) Field of Classification Search
None
See application file for complete search history.

(56) References Cited

U.S. PATENT DOCUMENTS 3,529,973 A * 9/1970 Eff ..... F24C 15/2014 426/243
2009/0020022 A1 1/2009 Liu

FOREIGN PATENT DOCUMENTS

| | | | |
|---|---|---|---|
| CN | 2803213 | Y | 8/2006 |
| CN | 204683369 | U | 10/2015 |
| CN | 105395091 | A | 3/2016 |
| CN | 205322151 | U | 6/2016 |
| CN | 208582246 | U | 3/2019 |
| CN | 209235750 | U | 8/2019 |
| TW | M321674 | U | 11/2007 |

OTHER PUBLICATIONS

First Office Action of CN Application No. 202011632995.5.
Notice of Allowance dated Oct. 28, 2022 for CN Application No. 202011632995.5.

* cited by examiner

*Primary Examiner* — Jason Lau

(57) ABSTRACT

An embodiment of the present disclosure provides an oven including a body, a door, a drawer and a stopper. The body is formed with a baking chamber and a receiving chamber, and the stopper is located at an end of the drawer away from the receiving chamber when the drawer moves into the receiving chamber and the door closes the baking chamber. The stopper is located at least partially between the door and the drawer.

9 Claims, 6 Drawing Sheets

OVEN FOR REDUCING USER SCALDING

CROSS-REFERENCES TO RELATED APPLICATIONS

The present application claims benefit of Chinese Application No. 202011632995.5, filed on Dec. 31, 2020, the contents of which are hereby incorporated by reference in its entirety.

FIELD

The present disclosure relates to the field of a food baking, and more particularly to an oven.

BACKGROUND

An existing oven is typically provided with a drawer, and a user may be scalded during drawing the drawer out of the oven.

SUMMARY

In view of this, an embodiment of the present disclosure is intended to provide an oven which can reduce a possibility of scalding a user during drawing the drawer out of the oven.

One embodiment of the present disclosure provides an oven including a body formed with a baking chamber and a receiving chamber, a door configured to open or close the baking chamber, a drawer configured to move into or out of the receiving chamber, and a stopper, which is located at an end of the drawer away from the receiving chamber when the drawer moves into the receiving chamber and the door closes the baking chamber. The stopper is located at least partially between the door and the drawer.

In an embodiment, the stopper includes an shutter plate and a connecting plate connected to each other, the connecting plate is connected to the door or the drawer, the shutter plate is located at the end of the drawer away from the receiving chamber when the drawer moves into the receiving chamber and the door closes the baking chamber, and the shutter plate is located between the door and the drawer.

In an embodiment, the shutter plate is located between the connecting plate and the body when the drawer moves into the receiving chamber and the door closes the baking chamber.

In an embodiment, the connecting plate is perpendicular to the shutter plate.

In an embodiment, the stopper is connected to a bottom of the door when the door is located above the drawer.

In an embodiment, the stopper is connected to the door, the door has a mounting position, and the stopper is formed with an avoidance groove for avoiding the mounting position.

In an embodiment, a notch of the avoidance groove faces toward the body when the door closes the baking chamber, the stopper is formed with a protrusion protruding along a side of the stopper away from the body, and the protrusion is aligned with the avoidance groove.

In an embodiment, a width of the avoidance groove gradually decreases in a direction away from the body from the notch.

In an embodiment, the door includes a door body configured to open or close the baking chamber, and a partition plate connected to the door body. The stopper is arranged to be spaced apart from the door body. A temperature of the partition plate is lower than a temperature of the door body. The stopper is connected to the partition plate.

In an embodiment, the partition plate includes: a main body of the partition plate, which is located at a side of the door body away from the body when the door body closes the baking chamber, and a mounting leg connected to the main body of the partition plate. The main body of the partition plate is arranged to be spaced apart from the door body. The mounting leg is connected to the door body, and the stopper is connected to the mounting leg.

In the oven according the embodiment of the present disclosure, since the stopper is located at the end of the drawer away from the receiving chamber when the drawer moves into the receiving chamber and the door closes the baking chamber, the stopper is located at least partially between the door and the drawer. In this case, when the user dips his/her hand into a gap between the drawer and the door to draw out the drawer, the user's hand will first contact with the stopper before touching the body. On the one hand, the stopper can prevent the user from contacting with the body to avoid scalding, and on the other hand, the user can actively stop the movement of the hand toward the body when the user contacts the stopper to protect the user from being scalded. Therefore, the possibility of scalding can be reduced during the user dips hand into the gap between the drawer and the door to open the drawer.

Figure 1:
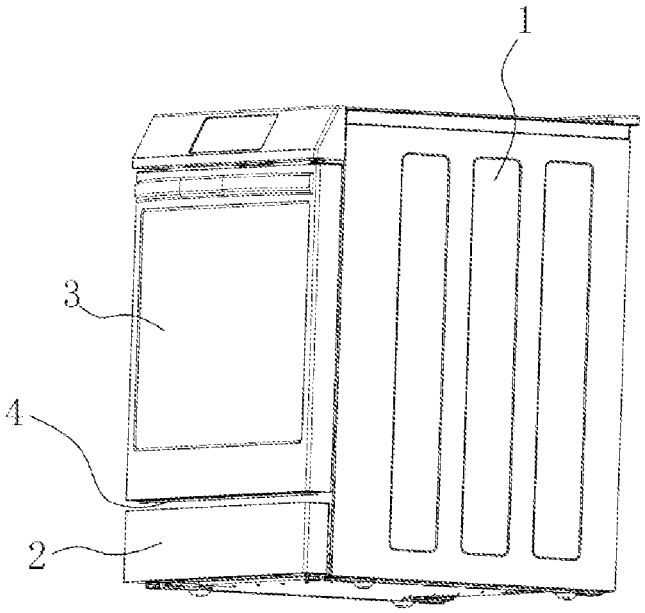
FIG. 1 is a schematic view of an oven according to an embodiment of the present disclosure.
Figure 2:
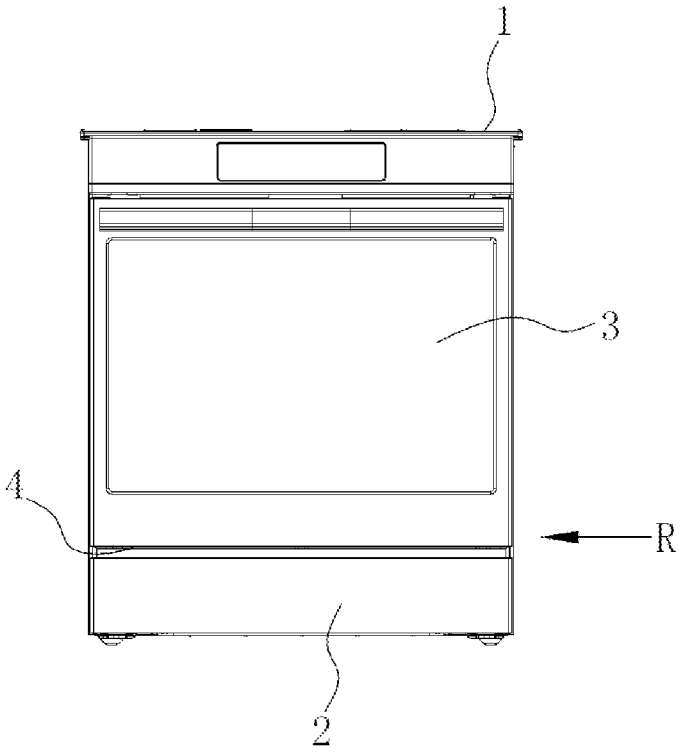
FIG. 2 is a schematic view of the oven of FIG. 1 from another perspective.

List of reference numerals: body 1; drawer 2; door 3; door body 31; partition plate 32; main body of the partition plate 321; mounting leg 322; stopper 4; shutter plate 41; connecting plate 42; avoidance groove 43; notch 431; protrusion 44; width D.

DETAILED DESCRIPTION OF THE DISCLOSURE

It should be noted that the embodiments of the present disclosure may be combined with each other if there is no conflict, and the detailed description in the detailed description should be understood as an explanation of the purpose of the present disclosure and should not be regarded as an undue limitation of the present disclosure.

Figure 3:
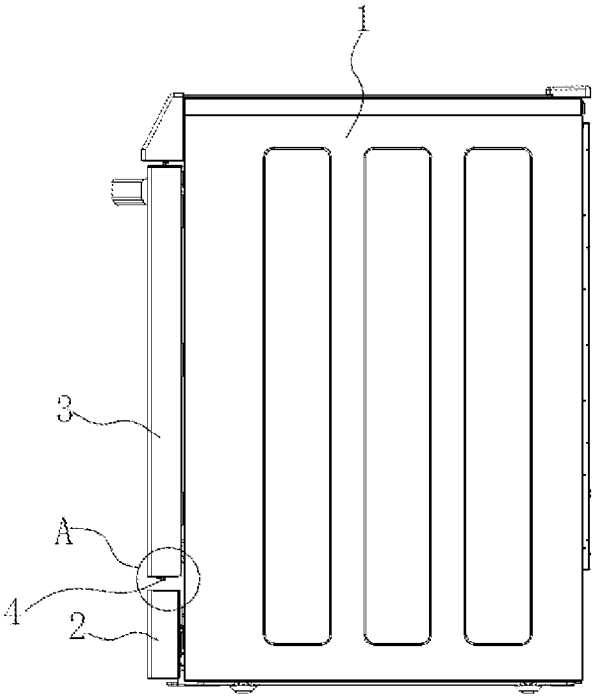
FIG. 3 is a view in an direction R in FIG. 2.
Figure 4:
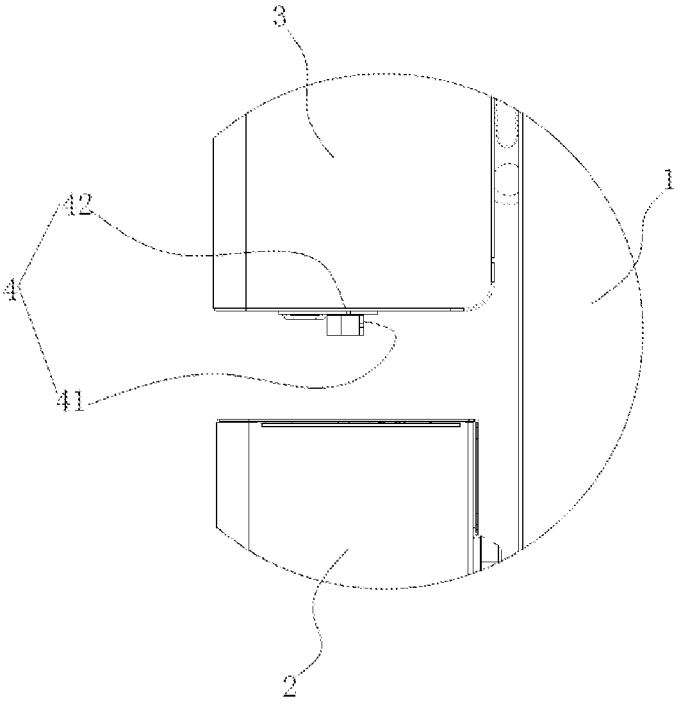
FIG. 4 is an enlarged view of area A in FIG. 3.

In the description of the present disclosure, an orientation or positional relationship indicated by terms "above", "below", "top", "bottom" is based on the orientation or positional relationship shown in the FIG. 3. It should be understood that these orientation terms are only for a convenience of describing the disclosure and simplifying the description, rather than indicating or implying a device or element referred to must have a specific orientation, be constructed and operated in the specific orientation, and therefore cannot be understood as a limitation of the present disclosure.

As a part of the inventive concept of the present disclosure, a reason why a user may be scalded during drawing the drawer out of an oven in the prior art needs to be analyzed before describing the embodiment of the present disclosure is obtained through reasonable analysis.

In the related art, the oven generally includes a body, a door, and a drawer. The body is formed with a baking chamber and a receiving chamber. Usually, when the drawer is moved into the receiving chamber and the baking chamber is closed by the door, there is a gap between the door and the drawer which are spaced apart from each other by a distance, so that a user may dip a hand into the gap between the door and the drawer to draw the drawer out of the body, to render the drawer accessible. However, the body is partially exposed at the gap between the door and the drawer, and a temperature of the body exposed at the gap between the door and the drawer is high due to factors such as a baking heating. When the user dips the hand into the gap between the door and the drawer to draw the drawer out of the body, the user's hand may contact the body exposed at the gap between the door and the drawer and be scalded.

In view of this, an embodiment of the present disclosure provides an oven. Referring to FIGS. 1 to 4, the oven includes a body 1, a door 3, a drawer 2, and a stopper 4. The body 1 is formed with a baking chamber and a receiving chamber. The door 3 is configured to open or close the baking chamber. The drawer 2 is configured to move into or out of the receiving chamber. The stopper 4 is located at an end of the drawer 2 away from the receiving chamber when the drawer 2 moves into the receiving chamber and the door 3 closes the baking chamber, and is located at least partially between the door 3 and the drawer 2. In this configuration, since the stopper 4 is located at the end of the drawer 2 away from the receiving chamber when the drawer 2 moves into the receiving chamber and the door 3 closes the baking chamber, the stopper 4 is located at least partially between the door 3 and the drawer 2. In this case, when the user dips his/her hand into a gap between the drawer 2 and the door 3 to draw out the drawer 2, the user's hand will first contact with the stopper 4 before touching the body 1. On the one hand, the stopper 4 can prevent the user from contacting with the body 1 to avoid scalding, and on the other hand, the user can actively stop the movement of the hand toward the body 1 when the user contacts the stopper 4 to protect the user from being scalded. Therefore, the possibility of scalding can be reduced during the user dips hand into the gap between the drawer 2 and the door 3 to draw out the drawer 2.

During actual use, thanks to the oven of the embodiment of the present disclosure, the user essentially will not be scalded when drawing the drawer 2 out of the body 1.

In an embodiment, referring to FIGS. 1 to 4, the door 3 may be generally located above the drawer 2.

In an embodiment, the baking chamber is generally located above the receiving chamber when the door 3 is located above the drawer 2.

In an embodiment, the door 3 may be located below the drawer 2.

In an embodiment, an arrangement direction along which the door 3 and the drawer 2 are arranged may also be perpendicular to a vertical direction.

In an embodiment, referring to FIGS. 1 to 7, in the case where the door 3 is located above the drawer 2, the stopper 4 is connected to a bottom of the door 3. In this configuration, the stopper 4 is connected to the bottom of the door 3, and does not move with the drawer 2 even if the drawer 2 is drawn out from the body 1. When the user picks or places some article in the drawer 2 and unintentionally approaches a high temperature portion of the body 1 exposed from the bottom of the door 3, the user still may contact the stopper 4 at first, to reduce the possibility of the user being scalded.

In an embodiment, in the case that the door 3 is located above the drawer 2, the stopper 4 may be connected to a top of the drawer 2.

In an embodiment, in the case that the door 3 is located below the drawer 2, the stopper 4 may be connected to a top of the door 3 or to the top of the drawer 2.

In an embodiment, in the case that the arrangement direction along which the door 3 and the drawer 2 are arranged is perpendicular to the vertical direction, the stopper 4 may be connected to a side of the door 3 facing toward the drawer 2 or to a side of the drawer 2 facing toward the door 3.

It will be understood that a connection manner between the stopper 4 and the door 3 is not limited.

In an embodiment, a riveting may be used for the connection between the stopper 4 and the door 3 or the drawer 2.

In an embodiment, a bolted may be used for the connection between the stopper 4 and the door 3 or the drawer 2.

In an embodiment, a welding may be used for the connection between the stopper 4 and the door 3 or the drawer 2.

In an embodiment, the stopper 4 may be a bar-shaped stopper.

Figure 6:
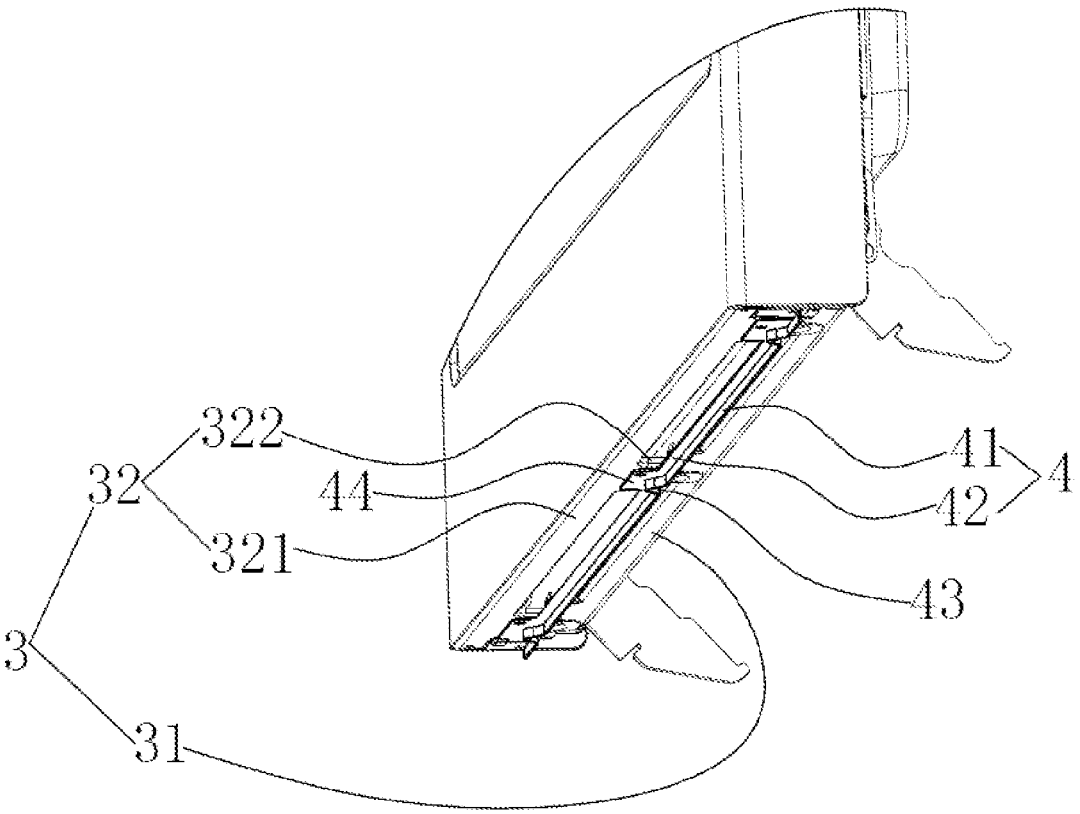
FIG. 6 is an enlarged view of area B in FIG. 5.
Figure 7:
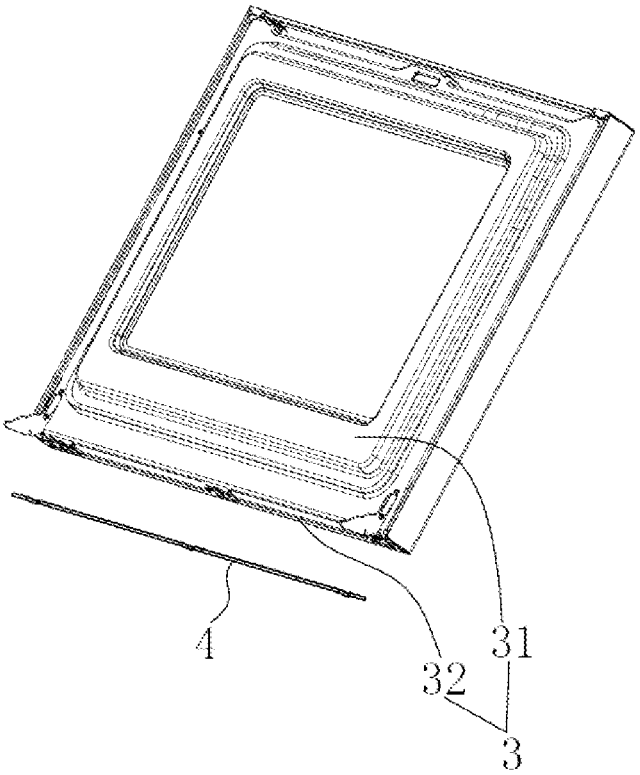
FIG. 7 is an exploded view of the door and the stopper of FIG. 5, showing a side of the door facing toward the body.
Figure 8:
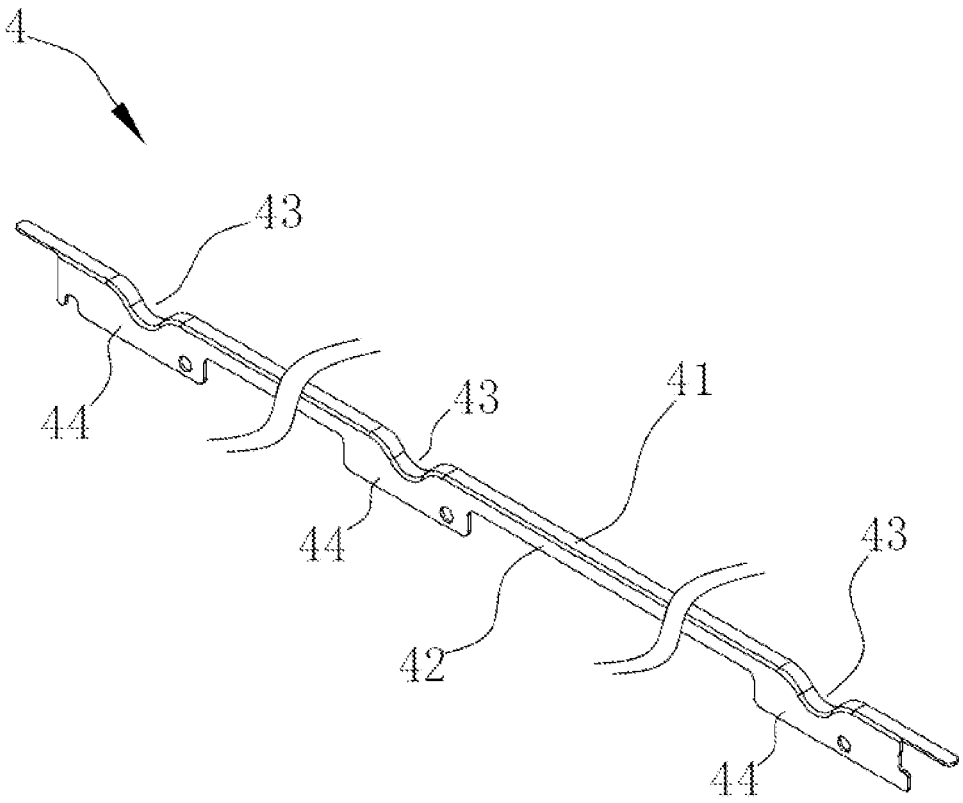
FIG. 8 is a schematic view of the stopper according to an embodiment of the present disclosure.
Figure 9:
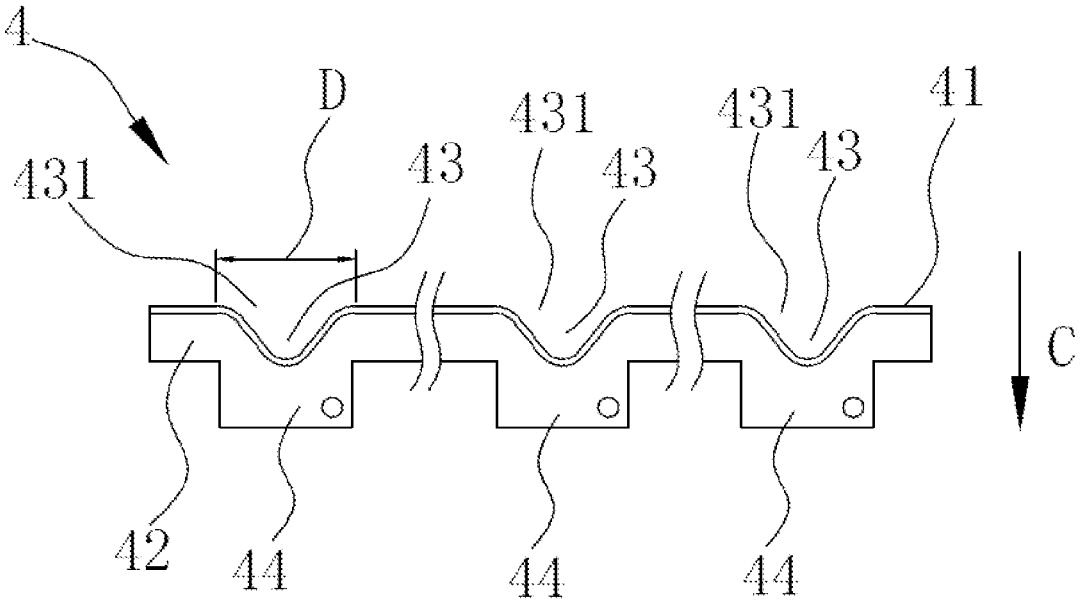
FIG. 9 is a schematic view of the stopper of FIG. 8, seen from another perspective.

In an embodiment, referring to FIGS. 6, 8 and 9, the stopper 4 includes a shutter plate 41 and a connecting plate 42 connected to each other. The connecting plate 42 may be connected to the door 3 or the drawer 2. When the drawer 2 moves into the receiving chamber and the door 3 closes the baking chamber, the shutter plate 41 is located at the end of the drawer 2 away from the receiving chamber, and is located between the door 3 and the drawer 2. In this configuration, the connecting plate 42 is connected to the door 3 or the drawer 2, so that the stopper 4 as a whole can be conveniently mounted on the door 3 or the drawer 2. The shutter plate 41 is located between the door 3 and the drawer 2, and located at the end of the drawer 2 away from the receiving chamber. When the user dips the hand into the gap between the door 3 and the drawer 2, on the one hand, the shutter plate 41 can prevent the user from contacting the body 1 to avoid the scalding, and on the other hand, the user can actively stop the movement of the hand toward the body 1 when the user contacts the shutter plate 41 to protect the user from being scalded. This reduces the possibility of scalding, and facilitates the installation of the stopper 4 and the door 3 or the drawer 2.

In an embodiment, the shutter plate 41 and the connecting plate 42 may be integrally formed.

In an embodiment, the shutter plate 41 and the connecting plate 42 may be two separate elements connected to each other.

In an embodiment, referring to FIGS. 3 to 6, 8 and 9, the connecting plate 42 may be connected to the bottom of the door 3 in the case where the door 3 is located above the drawer 2.

In an embodiment, the connecting plate 42 may be connected to the top of the drawer 2 in the case where the door 3 is located above the drawer 2.

In an embodiment, the connecting plate 42 may be connected to the top of the door 3 in the case where the door 3 is located below the drawer 2.

In an embodiment, the connecting plate 42 may be connected to the bottom of the drawer 2 in the case where the door 3 is located below the drawer 2.

In an embodiment, the connecting plate 42 may also be connected to the door 3 or the drawer 2 in the case that the arrangement direction along which the door 3 and the drawer 2 are arranged is perpendicular to the vertical direction.

It will be understood that the connecting plate 42 is connected to the door 3 or the drawer 2, but the connecting plate 42 is not necessarily located between the door 3 and the drawer 2. In an embodiment, the connecting plate 42 may be connected to the door 3 or the drawer 2 at an area other than the area between the door 3 and the drawer 2.

It will be understood that, if an available space on a side of the shutter plate 41 away from the body 1 is insufficient, it may cause inconveniently for the user to dip the hand into the gap between the door 3 and the drawer 2 to act on the drawer 2, and thus it is hard to draw the drawer 2 out of the body 1. In view of this, in an embodiment, referring to FIGS. 6, 8 and 9, the shutter plate 41 may be located between the connecting plate 42 and the body 1 when the drawer 2 moves into the receiving chamber and the door 3 closes the baking chamber. In this configuration, the shutter plate 41 can be properly located close to the body 1 with respect to the connecting plate 42. On the one hand, sufficient available space can be left on the side of the shutter plate 41 away from the body 1, so that the user can easily dip the hand into the gap between the door 3 and the drawer 2 to draw the drawer 2 out of the body 1, and on the other hand, when the relatively sufficient available space can be left on the side of the shutter plate 41 away from the body 1, the possibility of scalding can be reduced by prevent the connecting plate 42 from being too close to the body 1, which causes the heat of the body 1 to be excessively conducted to the shutter plate 41 through the connecting plate 42.

In an embodiment, the connecting plate 42 may be located between the shutter plate 41 and the body 1 when the drawer 2 moves into the receiving chamber and the door 3 closes the baking chamber.

In an embodiment, referring to FIGS. 6, 8, and 9, the connecting plate 42 may be perpendicular to the shutter plate 41.

In an embodiment, an acute angle or an obtuse angle may be formed between the connecting plate 42 and the shutter plate 41.

It will be understood that a heat of the body 1 does not excessively conduct to the stopper 4 when the stopper 4 is at a suitable position. The available space on a side of the stopper 4 away from the body 1 is sufficient when the drawer 2 moves into the receiving chamber and the door 3 closes the baking chamber, so that the user can easily dip the hand into the gap between the door 3 and the drawer 2 to draw out the drawer 2. However, the stopper 4 may just partly enclose a mounting position on the door 3 when the stopper 4 is in a suitable position. If the position of the stopper 4 is moved toward the side away from the body 1 to avoid the mounting position, the space on the side of the stopper 4 away from the body 1 may be insufficient and the drawer 2 can not be drawn out easily. If the position of the stopper 4 is moved toward the body 1 to avoid the mounting position, the stopper 4 may be too close to the high temperature portion of the body 1, which cause the temperature of the stopper 4 to become too high, and may scald the user. In view of this, in an embodiment, referring to FIGS. 5 to 9, the stopper 4 is connected to the door 3; the door 3 having the mounting position, and the stopper 4 is formed with an avoidance groove 43 for avoiding the mounting position (i.e., the stopper will not interfere with the installation position). In this configuration, the stopper 4 can avoid the mounting position of the door 3 through the avoidance groove 43, so that the stopper 4 does not need to be completely removed from a relatively suitable position. Under the premise that the stopper 4 is not overheated and the space on the side of the stopper 4 away from the body 1 is sufficient, the user can easily disassemble and assemble the mounting position of the door 3 through the avoidance groove 43.

It will be understood that the part of the mounting position of the door 3 may need to be connected by riveting or bolting. The part of the mounting position of the door 3 may also be connected by other means other than riveting or bolting. Installation or disassembly and assembly operations may be required at these mounting positions.

In an embodiment, the mounting position of the door 3 may be the position where the rivet is located, and the user may disassemble the rivet through the avoidance groove 43 to remove the rivet.

In an embodiment, the mounting position of the door 3 may be the position where the bolt is located, and the user may tighten or loosen the bolt through the avoidance groove 43.

In an embodiment, referring to FIGS. 5 to 9, the stopper 4 is connected to the bottom of the door 3; the bottom of the door 3 has a mounting position.

In an embodiment, referring to FIGS. 3 to 9, a notch 431 of the avoidance groove 43 faces toward the body 1 when the door 3 closes the baking chamber. The stopper 4 is formed with a protrusion 44 protruding along the side of the stopper 4 away from the body 1, and the protrusion 44 is aligned with the avoidance groove 43. In this configuration, since the notch 431 faces toward the body 1 and the protrusion 44 protrudes along the side of the stopper away from the body 1 and is aligned with the avoidance groove 43, the mounting position of the door 3 is avoided and the strength of the stopper 4 is enhanced, and the protrusion 44 can be far away from the body 1. In such a way, it can be avoided that the protrusion 44 is too close to the body 1 and the heat of the body 1 is excessively conducted to the stopper 4 through the protrusion 44, to reduce the possibility of the user being scalded.

In an embodiment, the notch 431 of the avoidance groove 43 may be far away from the body 1 when the door 3 closes the baking chamber, and the protrusion 44 may protrude along the side of the stopper facing toward the body 1.

In an embodiment, referring to FIG. 6, the protrusion 44 may be connected to the door 3.

In an embodiment, referring to FIG. 9, the notch 431 of the avoidance groove 43 faces toward the body 1 when the door 3 closes the baking chamber, the protrusion 44 protrudes along the side of the stopper 4 away from the body 1, and the protrusion 44 is aligned with the avoidance groove 43. A width D of the avoidance groove 43 gradually decreases in a direction away from the body 1 from the notch 431. In this configuration, the width D of the avoidance groove 43 is reduced, and accordingly, the width of the protrusion 44 can be reduced with the strength requirements of the stopper 4 is met. Therefore, the amount of material can be reduced and the cost can be saved.

It should be explained that, referring to FIG. 9, the direction of the notch 431 away from the body 1 is the direction indicated by the arrow C in the figure.

In an embodiment, the width D of the avoidance groove 43 may be constant in the direction away from the body 1 from the notch 431.

In an embodiment, referring to FIGS. 4, 6, 8, and 9, the shutter plate 41 is located between the connecting plate 42 and the body 1 when the door 3 closes the baking chamber; the shutter plate 41 defines the avoidance groove 43, and an opening of the avoidance groove 43 faces toward the body 1. The protrusion 44 is formed on the connecting plate 42, and the protrusion 44 protrudes along the side of the connecting plate 42 away from the body 1.

Figure 5:
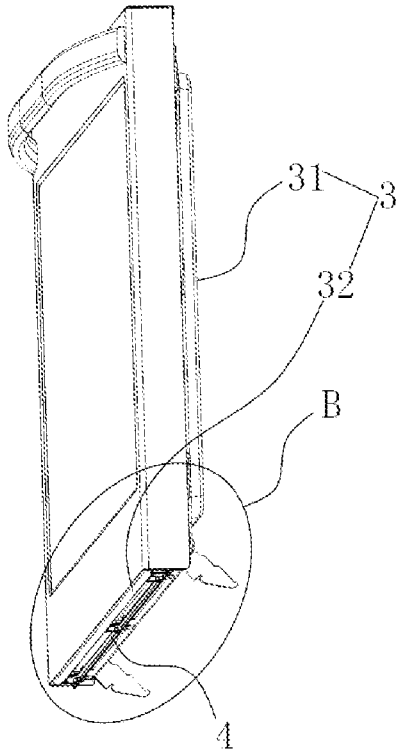
FIG. 5 is a schematic assembly view of a door and a stopper according to an embodiment of the present disclosure.

In an embodiment, referring to FIGS. 5 and 6, the door 3 includes a door body 31 and a partition plate 32. The door body 31 is configured to open or close the baking chamber, and the stopper 4 is arranged to be spaced apart from the door body 31. The partition plate 32 is connected to the door body 31. A temperature of the partition plate 32 is lower than a temperature of the door body 31, and the stopper 4 is connected to the partition plate 32. In this configuration, since the temperature of the partition plate 32 is lower than the temperature of the door body 31 and the stopper 4 is arranged to be spaced apart from the door body 31, the stopper 4 is connected to the partition plate 32 having a lower temperature. Accordingly, the temperature of the stopper 4 is relatively low, so that the possibility of scalding can be reduced.

In an embodiment, referring to FIGS. 5 and 6, the protrusion 44 of the stopper 4 is connected to the partition plate 32.

In an embodiment, referring to FIGS. 5 and 6, the partition plate 32 includes a main body 321 and a mounting leg 322. The main body 321 of the partition plate is located at a side of the door body 31 away from the body 1 when the door body 31 closes the baking chamber. The main body 321 of the partition plate is arranged to be spaced apart from the door body 31. The mounting leg 322 is connected to the main body 321 of the partition plate, the mounting leg 322 is also connected to the door body 31. The stopper 4 is connected to the mounting leg 322. In this configuration, the main body 321 of the partition plate is arranged to be spaced apart from the door body; by connecting the mounting legs 322 with the door body 31, the contact area between the main body 321 of the partition plate and the door body 31 is small on the whole, so that the heat conduction efficiency between the door body 31 and the partition plate 32 is low, and the partition plate 32 as a whole can maintain a low temperature relative to the door body 31.

In an embodiment, a material of the partition plate 32 may be a thermally insulating material according to actual requirements.

In an embodiment, the protrusion 44 of the stopper 4 may be connected to the mounting leg 322.

The various embodiments/implementations provided in the present disclosure may be combined with each other if there is no conflict.

What is claimed is:

1. An oven, comprising:

a body formed with a baking chamber and a receiving chamber;

a door configured to open or close the baking chamber;

a drawer configured to move into or out of the receiving chamber; and a stopper, which is located at an end of the drawer away from the receiving chamber when the drawer moves into the receiving chamber and the door closes the baking chamber, the stopper being located at least partially between the door and the drawer;

wherein the stopper is connected to the door, the door having a mounting position, and the stopper being formed with an avoidance groove for avoiding the mounting position.

2. The oven according to claim 1, wherein the stopper comprises an shutter plate and a connecting plate connected to each other, the connecting plate being connected to the door; and the shutter plate is located at the end of the drawer away from the receiving chamber when the drawer moves into the receiving chamber and the door closes the baking chamber, the shutter plate being located between the door and the drawer.

3. The oven according to claim 2, wherein the shutter plate is located between the connecting plate and the body when the drawer moves into the receiving chamber and the door closes the baking chamber.

4. The oven according to claim 2, wherein the connecting plate is perpendicular to the shutter plate.

5. The oven according to claim 1, wherein the stopper is connected to a bottom of the door when the door is located above the drawer.

6. The oven according to claim 1, wherein a notch of the avoidance groove faces toward the body when the door closes the baking chamber; and the stopper is formed with a protrusion protruding along a side of the stopper away from the body, the protrusion being aligned with the avoidance groove.

7. The oven according to claim 6, wherein a width (D) of the avoidance groove gradually decreases in a direction away from the body from the notch.

8. The oven according to claim 1, wherein the door comprises:

a door body configured to open or close the baking chamber, the stopper being arranged to be spaced apart from the door body; and a partition plate connected to the door body, a temperature of the partition plate being lower than a predetermined temperature of the door body, and the stopper being connected to the partition plate.

9. The oven according to claim 8, wherein the partition plate comprises:

a main body of the partition plate, which is located at a side of the door body away from the body when the door body closes the baking chamber, the main body of the partition plate being arranged to be spaced apart from the door body; and a mounting leg connected to the main body of the partition plate, the mounting leg being connected to the door body, and the stopper being connected to the mounting leg.

* * * * *